United States Patent [19]

Vickers et al.

[11] Patent Number: 4,643,781

[45] Date of Patent: Feb. 17, 1987

[54] METHOD OF HEAT TREATING VALVE INSERTS

[75] Inventors: Robert V. Vickers, Chagrin Falls; Peter D. Sachtjen, South Russell, both of Ohio

[73] Assignee: Tocco, Inc., Boaz, Ala.

[21] Appl. No.: 732,739

[22] Filed: May 10, 1985

[51] Int. Cl.[4] ..... C21D 1/42

[52] U.S. Cl. ..... 148/127; 148/130; 148/154; 219/10.43; 219/10.57; 123/188 S

[58] Field of Search ..... 148/150, 130, 154, 113, 148/127, 125; 219/10.43, 10.41, 10.57; 123/188, 189 VA, 188 S

[56] References Cited

U.S. PATENT DOCUMENTS

| | | | |
|---|---|---|---|
| 2,017,154 | 10/1935 | Larkin | 123/188 S |
| 2,165,311 | 7/1939 | Staneliff | 123/188 S |
| 3,834,013 | 9/1974 | Geistel | 148/130 |
| 4,100,834 | 7/1978 | Harris | 85/77 |
| 4,236,495 | 12/1980 | Rosan, Jr. | 123/188 S |
| 4,438,310 | 3/1984 | Cachat | 219/10.43 |
| 4,497,673 | 2/1985 | Esser | 148/127 |

*Primary Examiner*—Christopher W. Brody

*Attorney, Agent, or Firm*—Body, Vickers & Daniels

[57] ABSTRACT

An induction hardened valve seat insert is provided with a ridged outer surface which establishes a mechanically locked engagement with the wall of the insert bore during the induction heating cycle.

1 Claim, 13 Drawing Figures

FIG. 1
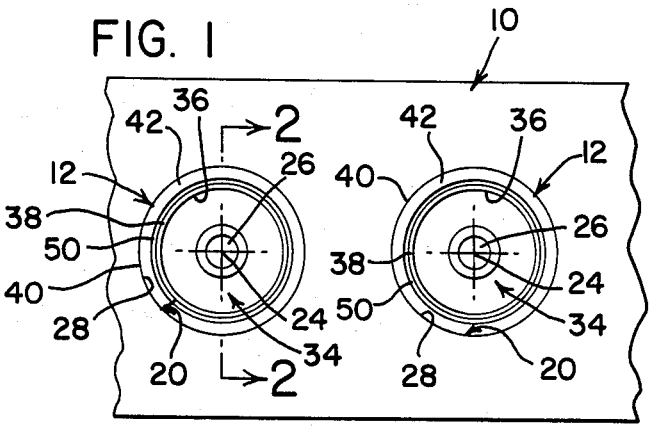
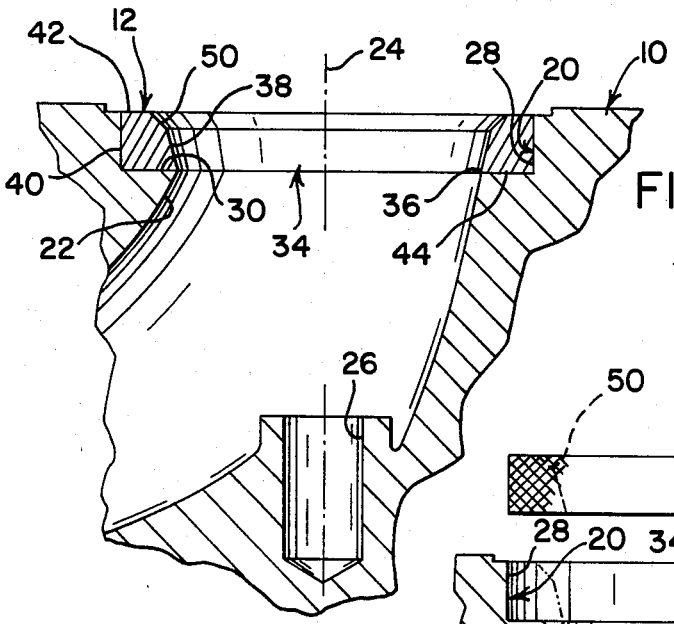
FIG. 2
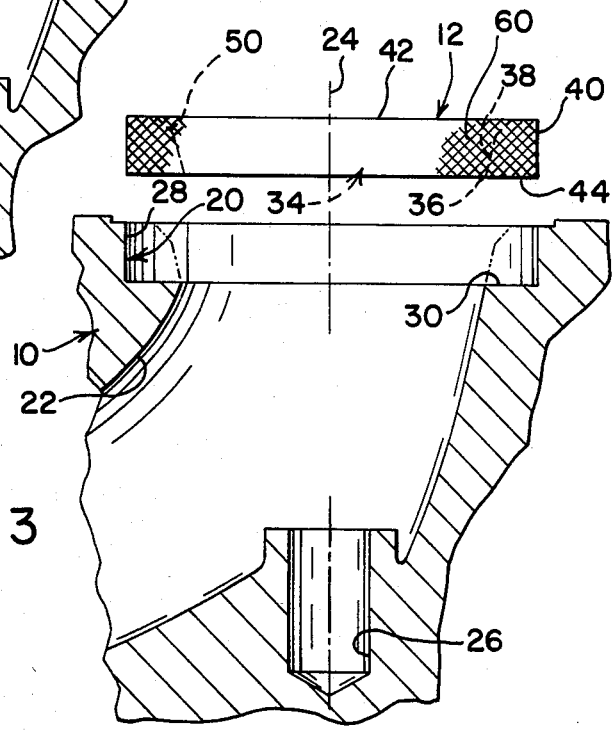
FIG. 3

FIG. 4
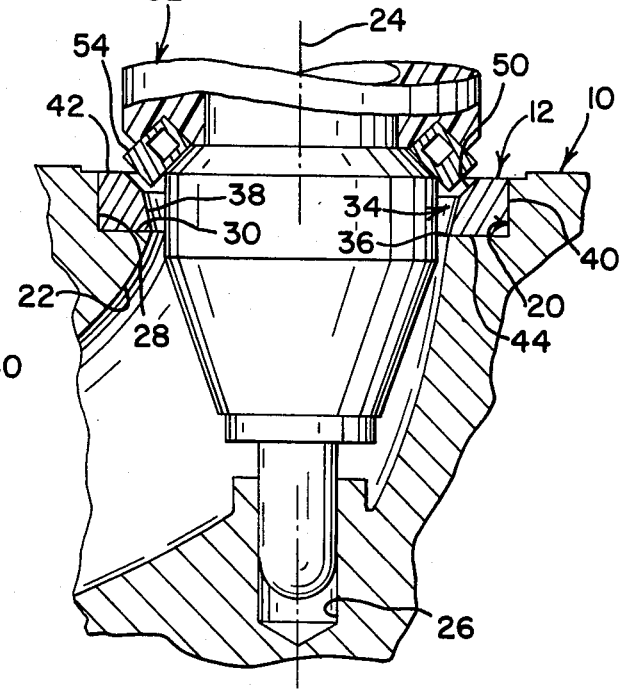
FIG. 5
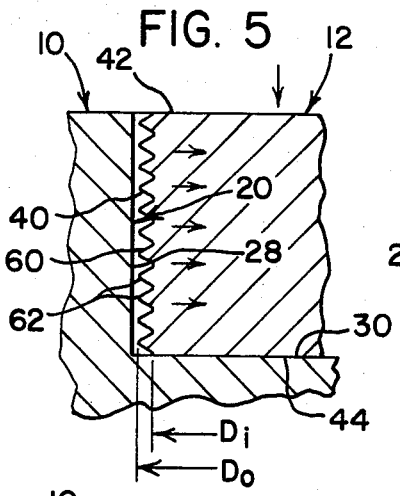
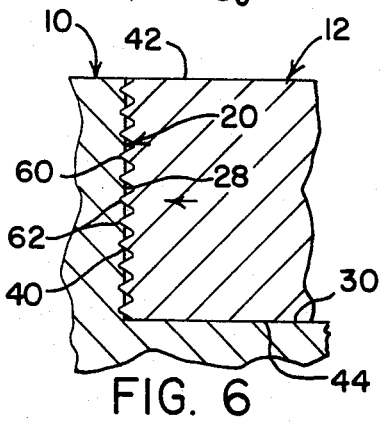
FIG. 6
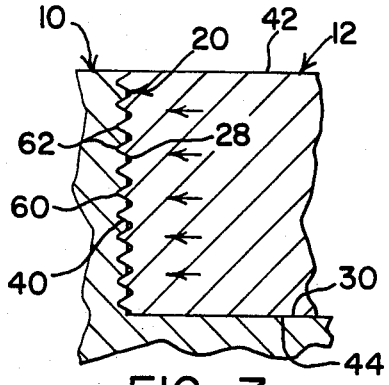
FIG. 7
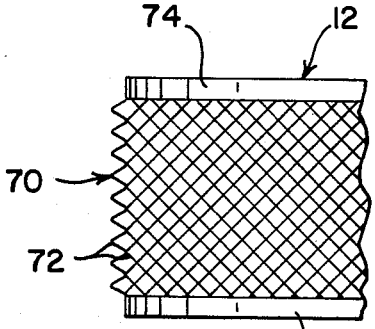
FIG. 8

METHOD OF HEAT TREATING VALVE INSERTS

BACKGROUND

The present invention relates to the art of induction heating and, more particularly to the heat treating of valve seat inserts of an engine component such as an engine head.

The invention is suitable for valve seat inserts which are heat treated after in-head machining of the valve seat surface, and particularly if the valve seat insert is subject to loosening under operating conditions and will be described with reference thereto; however, it will be appreciated that the invention has broader applications and may be used for the heat treating of various hardenable inserts in both ferrous and non-ferrous components wherein secure mechanical retention of the insert is required under operating conditions.

It has become commonplace to utilize hardened valve seat inserts in internal combustion engine heads which coact with the reciprocating intake and exhaust valves to control the flow of intake and exhaust gases to and from the engine combustion chamber. This is particularly true where the temperature and operation cause accelerated wear of the valve seat surface if formed directly on the engine head. Therein, the strength and wear properties of the seating surface are not sufficient to provide acceptable service life. This is manifest in aluminum components but also arises in case iron and other ferrous components operating under severe service conditions. To overcome these deficiencies, roughtly machined valve seat inserts which are inserted into the engine head, accurately machined to final size and subsequently heat treated have become the preferred assemblies. The method and apparatus as disclosed in U.S. Pat. No. 4,438,310, assigned to the assignee of the present invention and is incorporated hereby by reference, is exemplary of a successful approach for accurately and uniformly providing accurately hardened valve seat surfaces yielding extended service life.

In such assemblies, the partially machined valve seat insert is compressively retained in a counterbore in the engine. The compressive retention force is provided by diametral interference between the outer diameter of the valve seat insert and the inner diameter of the counterbore and is generally in the range of 0.003 to 0.007 inches. This compressive retention may be provided by fitting the insert into the counterbore or alternatively by cryogenically cooling the insert to establish a diametral clearance between the insert and the bore, inserting the cooled insert into the bore, and allowing the insert to warm to ambient conditions. The valve seat insert is thereafter machined to size. During the subsequent inductive heating, the insert-head interface temperature is controlled by conduction and/or magnetic shielding or control of the power level to prevent excessive heating which would damage the engine head and destroy the pressure fit with the insert. These have proven to be effective techniques, particularly for aluminum heads.

Nonetheless, it has been found that some of the inserts are nonetheless subject to loosening in service, notwithstanding apparently satisfactory post assembly inspection. Inasmuch as loosening in service can cause substantial engine damage and is costly and time consuming to repair, there is a need to further improve the service retention of the inserts.

One of the largest contributors to valve seat loosening is the loss of compressive retention force during the inductive heating cycle. This can occur when the thermal expansion of the insert deforms and enlarges the bore diameter. Therein, the valve seat insert expands during the inductive heating whereas the engine head is not similarly affected to a similar extent due to the supplemental cooling and/or heat sink mass of the head, notwithstanding a greater thermal coefficient of expansion as is the case for an aluminum head. As a result of ambient temperatures, a loss of interference will be realized. Moreover, during engine operation, both the insert and the head reach a greater temperature equilibrium. Thereat, the differences in the expansion coefficients result in the bore diameter expanding at a greater rate than the insert and a further reduction or complete loss of retention. Under dynamic operation, the insert can loosen or eject resulting in engine failure.

BRIEF DESCRIPTION OF THE PRESENT INVENTION

The present invention seeks to overcome the above problems by providing a valve seat insert having a mechanically interlocking engagement with the bore side wall, which engagement is increased during the inductive heating without a reduction in the pressure fit between the bore and the insert and without the necessity of supplemental shielding devices or limitation of the heating cycle. This is accomplished by providing the outer circumferential wall of the insert with radially outwardly projecting ridged wall surfaces which engage and locally swage the bore side wall during the temperature rise to the heat treating temperature. This swaging accommodates the differential expansion without reducing the basic diametral interference between the parts while establishing a mechanical interlock between the surfaces. During engine operation, the design pressure fit is maintained while the interlock acts as further insurance against dynamic loosening of the insert. The ridged wall surfaces may take the form of knurling, rings, helical threads, splines, herringbores or the like. The walled surfaces may span all or part of the outer wall and preferably project 0.001 to 0.003 inches beyond the outer wall, producing a 0.003 to 0.007 inch interference fit with the bore side wall. The projections are provided with sharply defined outer edges to assist in swaging while limiting direct contact with the bore wall.

Accordingly, a primary object of the present invention is the provision of a valve insert and method of installation therefore which effects a mechanical interlock with an engine component without destruction of the pressure fit therebetween.

Another object of the invention is the provision of a valve seat insert for an engine component having an outer surface with a walled configuration effective to establish a mechanical interlock with the engine component during inductive heat treating of the insert.

A further object of the invention is the provision of a valve seat insert for an engine component wherein diametrically projecting walled surfaces on the insert are swaged against the engine component bore wall to effect local deformation of the bore wall and a resultant mechanical lock therebetween.

Still another object of the invention is the provision of a method for heat treating valve seat inserts retained in a bore of an engine component wherein the outer cylindrical wall of the insert is provided with minute ridged surfaces which project less than about 0.003 inches and the insert is cryogenically cooled and the valve insert positioned in the bore and inductively heated to swage the ridged surfaces against the wall.

Yet another object of the invention is the provision of a hardenable ferrous insert for a non-ferrous engine head wherein the outer cylindrical surface of the insert includes a circumferential band of sharp projections which locally swage the abutting wall of the head during inductive heat treating of the insert to establish a mechanical interlock therebetween without adversely effecting the designed mechanical compressive engagement therebetween.

BRIEF DESCRIPTION OF THE DRAWINGS

The above objects and other features of the present invention will become apparent to those skilled in the art upon reading the following detailed description of the preferred embodiments taken in conjunction with the accompanying drawings in which:

FIG. 1 is a partial plan view of an engine head provided with valve seat inserts in accordance with the present invention;

FIG. 2 is a sectional view taken along line 2—2 in FIG. 1 showing the assembly of the valve seat insert in the engine head;

FIG. 3 is a view similar to FIG. 2 showing the valve seat insert prior to insertion into the engine head bore;

FIG. 4 is a side elevational view of the valve seat inductor in operative position for inductively heat treating the valve seat insert;

FIG. 5 is an enlarged partially sectioned view showing the valve seat insert and the bore wall at the insertion temperature;

FIG. 6 is a view similar to FIG. 5 showing the valve seat insert and the bore wall at ambient temperatures;

FIG. 7 is a view similar to FIG. 5 showing the valve seat insert at the inductive heating temperature; and, FIGS. 8–13 are further embodiments of the valve seat insert in accordance with the present invention.

DETAILED DESCRIPTION OF THE INVENTION

Figure 9:
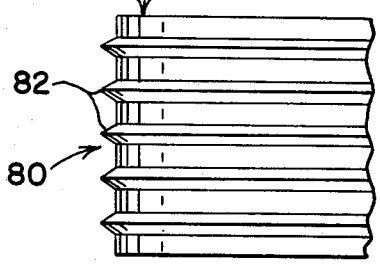

Referring to the drawings, FIG. 1 shows an engine component 10, such as an engine head for an internal combustion engine, having a plurality of valve seat inserts 12. In a conventional engine operation, poppet valves, not shown, reciprocate with respect to the inserts 12 and have conical surfaces seating on the inserts to control the flow of intake and exhaust gases to and from an associated combustion cylinder. To insure proper control of the gas flow, it is important to have the insert seating surface accurately oriented with respect to the valve reciprocation and hardened to resist wear and provide increased service life. Accordingly, the seating surfaces are machined to final size and quench hardened in place as hereinafter described.

Referring to FIG. 2, the head 10, formed of a non-ferrous material such as aluminum or a ferrous material such as cast iron, has a cylindrical counterbore 20 formed in the outer surface of the head 10 and communicating with a passageway 22 leading to an engine intake or exhaust manifold, not shown. The counterbore 20 is disposed concentrically about an axis 24 with a pilot hole 26 formed in the remote wall of the passageway 22. The counterbore 20 is defined by a cylindrical side wall 28 of circular cross-section contiguous with a radially inwardly extending annular base wall 30. The relative dimensions of the base wall 30 and the side wall 28 are dependent on the design of the overall engine. The valve seat insert 12 is formed of a hardenable ferrous material such as stainless steel, cast iron, powdered iron or the like.

Referring to FIGS. 2 and 3, the insert 12 has a ring-like construction defined by surfaces of revolution about an axis 32 and including a central passage having a cylindrical lower section 36 and a conical upper section 38, a cylindrical outer side wall 40 of circular cross-section and an annular top wall 42 and a base wall 44. As shown in FIG. 2, in assembly the base wall 40 of the insert 12 seats against the base wall 30 of the counterbore 20 in the head 10, and the side wall 40 of the insert 12 compressively engages the side wall 28 of the head 10, as hereinafter described in greater detail. Preferably, the insert 12 is assembled to the head 10 by cryogenically cooling the insert 12, such as by immersion in liquid nitrogen, until the thermal contraction establishes a sliding or light press fit between the side walls, inserting the cooled insert 12 into seated relationship with the counter bore 20, and allowing the insert 12 to warm to ambient temperatures at which time the aforementioned compressive engagement is effected by thermal expansion of the insert. Thereafter, the insert 12 is conventionally machined to provide a frustoconical valve seating surface 50 adjacent the conical wall 38 and the top wall 42.

Subsequent thereto, as shown in FIG. 4, the seating surface 50 is conventionally heat treated by means of an inductor 52 carrying a single loop inductor coil 54. The coil 54 is placed in controlled magnetically coupled relation with the surface 50 and conventionally energized by a suitable high frequency power supply, not shown, at a power level and length of time sufficient to inductively heat the material surrounding the surface to a material dependent heat treating temperature. Thereafter, the power supply is deenergized and the insert is mass quenched by the heat sink effect of the engine heat 10 or by directly quenching the insert with coolant delivered through the inductor to harden the seating surface 50. Under certain circumstances, the temperature excursions of the heat treating can cause valve seat misalignment or component deformation such that during engine operation, valve seating is impaired or insert retention is lost. As shown in FIG. 2, in order to aleviate these problems, the side wall 40 of the insert 12 is provided with outward projection in the form of a knurled surface 60. As hereinafter described, the surface 60 effects a swaged mechanical interlock with the side wall 28 of the head 10 to provide increased resistance to misalignment and deformation. More particularly, as a result of the knurling of the side wall 40 of the insert, a circumferential array of diametral projections are formed projecting from a base side wall of a base diameter $D_i$ and terminating in circumferentially aligned apexes of an outer diameter $D_o$ (FIG. 5). Preferably, the projections extend radially outwardly from the side wall between 0.001 to 0.003 inches such that the differences in the diameters is between 0.002 to 0.006 inches. The outer diameter $D_o$ has a diametral interference with the side wall 28 of the head 10 of about 0.004 to about 0.007 inches and sufficient to permit seated insertion of the cooled insert 12 into the counterbore 20 as shown in FIG. 5. Upon temperature rise to ambient temperatures, the insert 12 expands and the apexes 62 are swaged against the side wall 28 of the head 10 resulting in localized deformation and resultant mechanical interlocking as shown in FIG. 6.

During the inductive heating cycle, the insert 12 is directly heated and undergoes substantial thermal expansion. The side wall of the head 10 however, is not directly heated and owing to the surrounding material and resultant heat sink effect does not undergo a similar temperature rise and thermal expansion, notwithstanding a greater thermal coefficient of expansion in the case of the non-ferrous materials such as aluminum. This preferential expansion results in a net increase in the compressive loading at the interface between the insert and the head and further localized swaging at the projections as shown in FIG. 7 and the base wall compressively engages the wall without deformation of either component.

Upon cooling, the compressive loading will not be substantially affected. This will be maintained during engine operation when more substantial temperature equilibrium pronounces the effect of differential thermal expansion. In other words, the mechanical interlock and compressive loading is maintained notwithstanding a preferential thermal expansion of the counterbore.

A further embodiment of the insert is shown in FIG. 8 wherein the side wall 70 of the insert 12 includes a central knurled section 72 and circumferential axially spaced machined bands 74 on either axial end thereof. The knurled section 72 effects the aforementioned swaging and interlocking while the bands 74 effect the continuous compressive engagement with the opposed bore surface. Referring to FIG. 9, a valve insert 12 is provided with a side wall 80 having an axial series of sharply defined circumferential rings 82 projecting from bases at the side wall and terminating with a pointed outer edge or tip which locally swages the opposed bore surface to establish the interlock.

Figure 10:
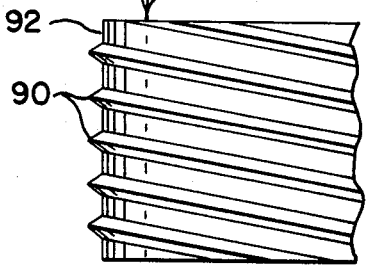
Figure 11:
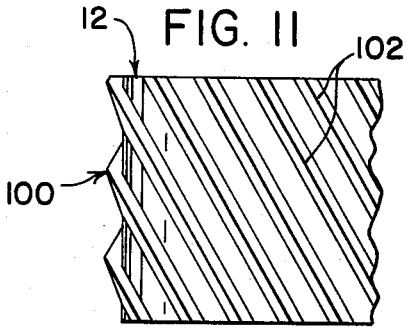
Figure 12:
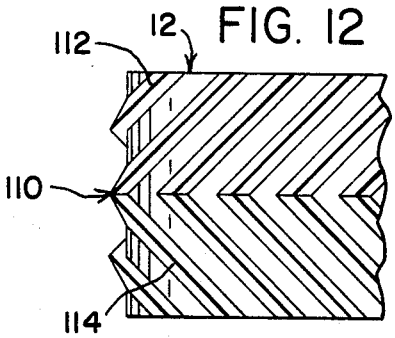
Figure 13:
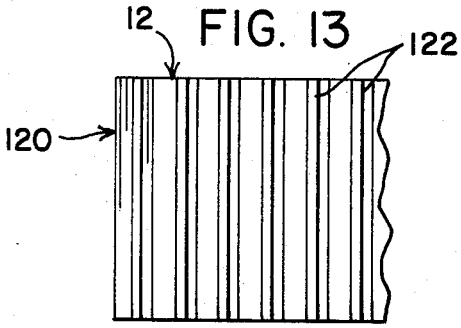

Referring to FIG. 10, the insert 12 is provided with sharply defined helical threads 90 on the side wall 92 having an outer edge for swaging the opposed wall in the aforementioned manner. Referring to FIG. 11, the side wall 100 of the insert 12 is provided with helical teeth 102 having bases at the outer wall and terminating radially outwardly with circumferentially aligned apexes. Referring to FIG. 12, the insert 12 is provided with radially outwardly extending projections in a herring bore pattern 110 having bases at the outer wall and terminating with apexes defined by diverging legs 112, 114. Referring to FIG. 13, the side wall 120 of the insert 12 is provided with axial splines 122 radially outwardly projecting from the outer wall and terminating with circumferentially aligned axial edges.

With each of the above embodiments, the inserts are cryogenically cooled to thermally contract the outer diameter sufficient to enable the insert to be seated in the engine head with a clearance or a light press fit, the latter of which should not substantially blunt or deform the projections in a manner which would substantially reduce the swaging effect during the subsequent thermal expansion phases. Thereafter, as the insert rises to ambient temperature, the initial swaging and interlocking of the components commences. During the inductive heating phase as previously mentioned, there is a net thermal expansion of the insert resulting in a further swaging of the interengaging surfaces while preventing a deformation as a result of the loading between the base diameter and the bore wall so as to maintain a net compressive loading therebetween. Moreover, the surface to surface contact between the engine head and the insert provides for sufficient heat transfer area to effect mass quenching of the insert when the inductive heating is terminated. As a result, the valve insert will be mechanically interlocked with and compressively retained in the head, notwithstanding a preferential thermal expansion of the head during steady state engine operating conditions. While the above embodiments set forth preferred arrangements for achieving the foregoing benefits, other physical variations may also be contemplated within the scope of the invention as set forth in the appended claims.

It is claimed:

1. A method of interlocking a valve seat insert within a cylindrical bore of an engine component comprising the steps of:

(a) providing a valve insert having an outer cylindrical surface including radially outwardly extending projections, the outer diameter of said projections at ambient temperature being greater than the diameter of said cylindrical bore and said projections having an inner diameter at ambient temperature less than the diameter of said bore;

(b) cooling said valve insert to thermally contract the insert radially such that said projections have at most a sliding fit with said bore;

(c) inserting said cooled valve insert in said bore;

(d) returning said cooled insert to ambient temperature to radially expand said insert and establish an initial mechanical interlocking of said insert within said bore by partial penetration of said projections into said bore;

(e) inductively heating said valve insert to cause thermal radial expansion of said insert and further radial penetration of said projections into said bore to establish a final mechanical interlocking of said valve insert axially in said bore; and, (f) cooling said valve insert to ambient temperature.

* * * * *